US005521690A

United States Patent [19]

Täffler et al.

[11] Patent Number: 5,521,690

[45] Date of Patent: May 28, 1996

[54] PNEUMATIC TONER TRANSPORT DEVICE FOR AN ELECTROGRAPHIC PRINTING OR COPYING MACHINE

[75] Inventors: Jürgen Täffler, München; Peter Rumpel, Feldkirchen-Westerham, both of Germany

[73] Assignee: Siemens Nixdorf Informationssysteme Aktiengesellschaft, Germany

[21] Appl. No.: 424,347

[22] PCT Filed: Oct. 12, 1993

[86] PCT No.: PCT/EP93/02805

§ 371 Date: May 22, 1995

§ 102(e) Date: May 22, 1995

[87] PCT Pub. No.: WO94/09412

PCT Pub. Date: Apr. 28, 1994

[30] Foreign Application Priority Data

Oct. 22, 1992 [EP] European Pat. Off. ..... 92118101

[51] Int. Cl.[6] ..... G03G 21/00

[52] U.S. Cl. ..... 355/298; 355/245; 118/652; 222/DIG. 1

[58] Field of Search ..... 355/298, 296, 355/245, 246; 118/652, 653; 222/DIG. 1

[56] References Cited

U.S. PATENT DOCUMENTS

| | | | |
|---|---|---|---|
| 3,439,650 | 4/1969 | Stowell . | |
| 3,703,957 | 11/1972 | Swanson et al. . | |
| 3,793,986 | 2/1974 | Latone . | |
| 3,894,514 | 7/1975 | Caudill et al. . | |
| 4,260,073 | 4/1981 | Baumann | 222/1 |
| 4,319,832 | 3/1982 | Sakamoto et al. . | |
| 4,724,459 | 2/1988 | Ford . | |
| 5,307,128 | 4/1994 | Murasaki et al. | 355/260 |

FOREIGN PATENT DOCUMENTS

| | | |
|---|---|---|
| 0221281 | 5/1987 | European Pat. Off. . |
| 0238939 | 9/1987 | European Pat. Off. . |

OTHER PUBLICATIONS

*Patent Abstracts of Japan,* vol. 8, No. 278, "Collecting Device of Developer", Yoshikazu Takahashi, 16 Aug. 1984.

*Patent Abstracts of Japan,* vol. 10, No. 282, "Cyclone Separator of Electrophotograhic Copying Machine", Toshio Watanabe, 19 May 1984.

*Primary Examiner*—R. L. Moses

*Attorney, Agent, or Firm*—Hill, Steadman & Simpson

[57] ABSTRACT

A pneumatic toner transport device for an electrographic printing or copying machine is used for transporting toner and for removing toner and/or dirt particles from units of the machine, such as developer station (10) and cleaning station (28). It contains a vacuum-producing device (31), which is connected via a vacuum duct system to the various units of the machine. Assigned to the duct system is a particle separator (24) in the form of a cyclone filter for separating toner and dirt particles out of an airstream flowing through. The particle mixture is separated in a recycling device into dirt particles and recyclable toner and the recyclable toner is supplied anew to the developer station. The dirt particles are collected in a fine filter (32) of the vacuum-producing device (31). The toner recycling device (25) is designed as an exchangeable constructional unit, which can be exchanged for a catchbox.

14 Claims, 9 Drawing Sheets

PNEUMATIC TONER TRANSPORT DEVICE FOR AN ELECTROGRAPHIC PRINTING OR COPYING MACHINE

BACKGROUND OF THE INVENTION

The invention relates to a pneumatic transport device for an electrophotographic printing or copying machine, having a device for feeding back excess toner to the developer station.

In electrographic printing or copying machines, which operate in accordance with the principle of electrophotography, ionography or magnetography, a latent image, which is inked in with toner in a developer station, is produced on an intermediate substrate with the aid of a drawing-generating device. The toner image is then transfer-printed in a transfer printing station onto the recording substrate and is fixed in a fixing station. Before the application of a new latent drawing image on the intermediate substrate, it is necessary to clean the intermediate substrate of adhering residual toner. This can be carried out with the aid of a brush and vacuum in a brush cleaning station. It can also be necessary in the developer station to suck up accumulating residual toner dust and to remove it from the developer station.

This accumulated toner is normally collected in a catchbox located in the machine and thrown away from time to time. Reuse of this accumulated toner was previously not envisaged since, in machines with high requirements on printing quality, only fresh toner can be processed.

Although it is already known in the case of electrophotographic printing devices to suck up the accumulation or excess toner from the cleaning station and from the developer station, to separate it in a cyclone separator from the suction air and to feed it once more continuously via a transport device to the developer station. It has emerged, however, that, in the case of high requirements on the printing quality, such a simple feeding back is not possible. The accumulated toner contains dirt particles, used toner particles and other particles disturbing the printing process, which have a negative effect on the printing quality.

U.S. Pat. No. 3,439,630 discloses a pneumatic transport device for an electrophotographic printing machine for transporting toner and/or dirt particles out of units of the machine. The device has two vacuum-producing devices in the form of air pumps and two particle separators in the form of cyclone filters, via which the excess toner in the region of the transfer printing station and the toner located in the developer space of the developer station is sucked up and is separated into dirt particles and reusable toner. The dirt particles are intercepted in a filter box and the reusable toner is supplied to the developer space, for example each time the printing device is switched on.

Similar devices are also described in JP-A-61 100 783 and JP-A-59 143 180.

A further problem in the recycling of toner consists in the fact that, for developing the charge images in the developer station, the toner must be charged up triboelectrically, specifically in a defined manner. If accumulated toner charged up in an undefined manner is re-supplied to the developer station, this can lead to disturbances in the charge behavior of the toner in the developer station, which in turn has a negative influence on the printing quality.

SUMMARY OF THE INVENTION

It is therefore an object of the invention to provide a pneumatic transport device for an electrographic printing or copying machine, having a toner feedback device, in which accumulated toner occurring in the units of the machine can be fed back in a simple manner into the developer station and can be reused, without the printing quality suffering thereby.

It is a further object of the invention to design the device in such a way that the toner transport can easily be matched to different requirements on the printing quality.

The objects are achieved by providing a pneumatic transport device for transporting toner to an electrographic imaging machine, such as an electrographic printing or copying machine, which also removes toner and/or dirt particles from components of the machine. Particularly, the device removes toner and dirt from the developer station and the cleaning station of the copier or printer. The transport device has a vacuum-producing device in communication with at least one selected location of the machine via a duct system to remove a flow of air and excess toner particles. The transport device includes a particle separator through which the duct system provides the flow, the separator having a means for separating the toner and/or dirt particles from the air flowing through the particle separator.

A toner recycling device is arranged to collect a toner particle mixture from the particle separator. The toner recycling device is connectable to the separator by a coupling means. The recycling device has a toner separating device with an associated supply device to separate recyclable toner from the particle mixture collected from the particle separator. The recycling device further supplies the recyclable toner, via a recycled toner transport duct to a developer station of the machine. A toner metering device provides toner to the developer station. The metering device receives a supply of toner from the toner recycling device and a fresh toner container. A means is also provided for controlling the supply of recyclable toner and fresh toner to the toner metering device.

In an embodiment, the toner recycling device is an independent, exchangeable module. In such an embodiment, a coupling means for is provided to interchangeably connect either a particle mixture accommodation container or the toner recycling device operably with the particle separator.

In an embodiment, the toner recycling device has a filter space with an opening in communication with the particle separator. A particle filter is disposed in the opening. The filter space also includes an exit region closeable by a controllable closure element and an air supply opening with an associated controllable closure element. A toner settling space is disposed under the exit region to receive collected toner particles therefrom. The toner settling space has a closeable air supply opening with an associated controllable closure element and an opening region through which toner particles flow to the transport duct.

In an embodiment, a control device actuates the closure elements of the toner recycling device in various modes. For cleaning the particle filter and for transporting away the dirt particles, the exit region of the filter space is closed and the air supply opening of the filter space is opened. For supplying the recyclable toner to the toner settling space when vacuum supplied to the transport duct is interrupted, the exit region of the filter space is opened and the air supply opening of the filter space is closed. For supplying the recyclable toner to the developer station when vacuum is applied to the transport duct, the exit region of the filter space is closed and the air supply opening of the toner settling space is opened.

In an embodiment, a sensor device is operably disposed in the toner settling space, detecting a toner filling level in the toner settling space.

In an embodiment, a fresh toner transport duct delivers toner to the developer station from a fresh toner supply container. A controllable closure device is operable to alternatingly close the recycled toner transport duct and the fresh toner transport duct.

In an embodiment, the controllable closure device is a two-way valve having transport ducts arranged on opposite sides of a rotatable eccentric roller. The eccentric roller alternatingly squeezes the transport ducts as the eccentric roller rotates.

In an embodiment, the toner metering device includes a buffer container which can receive toner from the toner recycling device and/or from the fresh toner container. The buffer container includes a selectively closable closure device to a duct in communication with the vacuum-producing device.

In an embodiment, the vacuum-producing device has a fine particle filter for picking up the dirt particles from the airflow through the vacuum-producing device.

In an embodiment, the particle separator is a cyclone filter.

A sensor detects a pressure difference upstream and downstream of the particle filter in order to determine whether the filter is soiled.

In an embodiment, the duct system has wall regions which contact the toner, dissipate charges and are made of electrically conductive material.

The present invention also provides a process for the pneumatic transport of toner and for the removal of toner and/or dirt particles from components of the electrographic imaging machine, such as from the developer station and cleaning station. The method includes suctioning a mixture of excess toner and/or dirt particles from the developer station and cleaning station machine by applying a vacuum to the units via a duct system. The suctioned particle mixture is then separated into non-reusable dirt particles and reusable toner. The reusable toner is mixed with fresh toner at a rate proportional to accumulation of reusable toner such that a constant mixing ratio is obtained. The mixed toner is supplied to the developer station. The dirt particles are collected in a catching device.

If, in printing or copying machines, the toner is transported with the aid of a pneumatic transport device, a toner recycling device can be arranged in the transport device in a simple and functionally reliable manner, said toner recycling device separating the recyclable toner from the sucked up accumulation or excess toner and feeding it anew to the developer station. Dirt particles and other particles having a negative influence on the printing quality are separately removed. Hence, the operating time of the machine with a predetermined toner supply is extended in an advantageous manner, without said toner supply having to be frequently renewed. The accumulating quantity of non-recyclable toner and of dirt particles is reduced to a minimum.

The pneumatic transport device can simultaneously be used for the purpose of removing and collecting other particles disturbing the printing operation, such as rubbed-off paper or stamping particles, from the units necessary for the paper transport, such as for example the paper brake. By means of the pneumatic transport, both the control of the feed of fresh toner end also the control of the feedback of the cleaned toner into the developer station are simplified and not susceptible to faults. Since vacuum prevails continuously in the transport system, no toner dust can emerge and soil the machine, even in the event of leaks in the system. The entire toner handling is significantly simplified.

In an advantageous embodiment of the invention, the toner recycling device is designed as an independent, exchangeable constructional unit. In the event of particularly high requirements on the printing quality, a catchbox for the accumulated toner can be arranged in a simple manner instead of the toner recycling device. The toner recycling device can be arranged anywhere in the machine. Since, in addition, the quantity of the accumulated residual toner is detected by measurement, a feeding back of the toner as a function of the residual toner accumulation can be carried out.

The particle filter serving for the separation is automatically cleaned, without it being necessary for this purpose to remove the filter from the machine. The pneumatic filter device serves both for the supply of fresh toner to the developer station and for feeding back the toner. Hence, a pneumatic transport system already present for fresh toner can be expanded, without significant and complicated constructional changes, as a function of the requirements on the machine, by means of a toner feedback device. The technical cost for a toner feedback system is significantly reduced. Since the developer station is supplied with toner in a controlled manner via a two-way valve, on the one hand from a supply container for fresh toner, on the other hand from an intermediate container for recyclable toner corresponding to the fresh toner, the toner supply is buffered. The supply of fresh toner and the intermixing of regained toner can thus be controlled as a function of the operating condition. A suddenly occurring impoverishment of toner in the developer station because of high toner use can easily be compensated for. The use of electrically conductive material for the duct system prevents an uncontrolled charging up of the toner during transport.

Additional features and advantages of the present invention are described in, and will be apparent from, the detailed description of the presently preferred embodiments and from the drawings.

BRIEF DESCRIPTION OF THE DRAWINGS

Embodiments of the invention are represented in the drawings and are described in more detail hereinafter by way of example.

DETAILED DESCRIPTION OF THE PRESENTLY PREFERRED EMBODIMENTS

Figure 1:
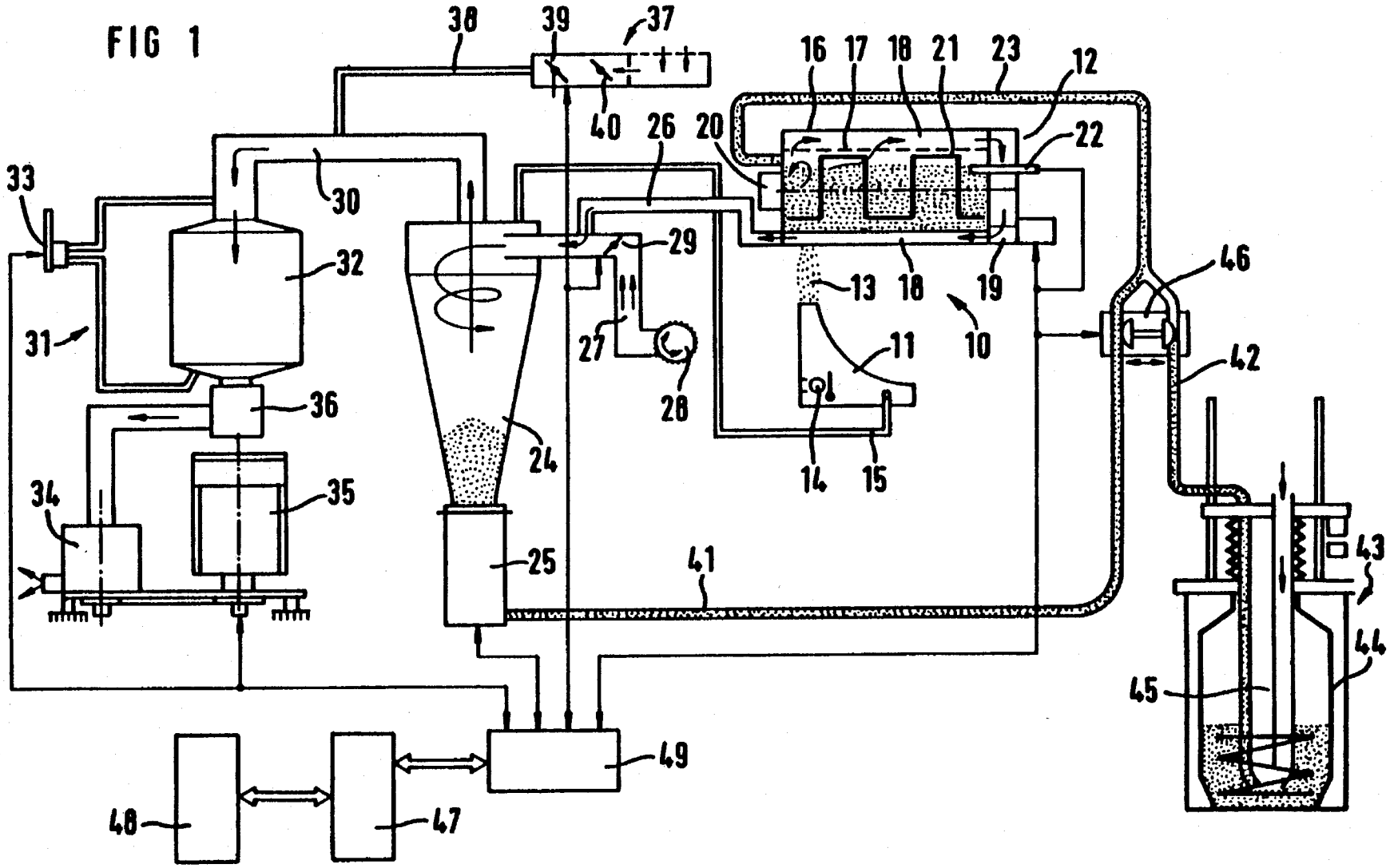
FIG. 1 shows a schematic functional circuit diagram of a pneumatic toner transport device for an electrographic printing machine.

As illustrated in FIG. 1, an electrophotographic printing device for printing endless paper contains a developer station 10 for inking in a charge image generated on a photoconductive drum with the aid of a developer mixture of toner particles and ferromagnetic carrier particles. In this arrangement, the developer station 10 is subdivided into a developer station housing 11 for the accommodation of application elements such as magnetic brushes, toner transport rollers and so on, and into a metering device 12, arranged above the developer station housing 11, for the metered supply of toner 13 to the developer station housing 11. Located on the developer station housing 11 there is an emptying opening 14 for suctioning the developer mixture out of the developer station housing and a suction duct 15 for suctioning the toner dust produced during the developer process in the region of application elements. A toner box 16, assigned to the metering device 12, contains a filter space, which serves as a buffer space for the toner and is covered by a toner filter 17. The toner filter 17 is designed in a semicircular shape, an air transport duct 18 being located between toner filter 17 and the walls of the toner box 16 and being led as far as a connection region on the toner box. Located in the air transport duct 18 there is an, electrically controlled closure device in the form of a suction-cycle valve 19 which, under electrical control, interrupts or permits the air transport in the air transport duct 18. The filter space contains a stirrer blade 21, driven via a motor 20, for mixing the toner 13 and a toner filling level sensor 22, which determines the toner filling level in the filter space, for example capacitively. Coupled to the filter space of the toner box is a toner transport duct 23 for the supply of toner into the filter space, specifically by means of applying vacuum to the air transport duct 18 when the suction-cycle valve 19 is opened. In this arrangement, the toner 13 settles in the filter space and is mixed by the stirrer blade 21, the stirrer blade 21 also sweeping along the inner side of the toner filter 17 and thus keeping the filter free. Underneath the filter space there is a supply device, not shown here, having a toner metering device, for example in the form of a foam roller resting on a wall, which supplies the toner in a metered manner to the developer station housing 11.

The toner transport device furthermore has a particle separator 24 in the form of a cyclone filter with a toner recycling unit 25, whose construction will be explained later, arranged underneath the cyclone filter 24. The cyclone filter 24 is coupled via the suction duct 15 to the developer station housing 11, via a suction duct 26 to the air transport duct 18 of the toner box and via a suction duct 27 to a cleaning station 28 for the photoconductive drum, an electrically adjustable throttle flap 29 being arranged in the suction duct 26 to the cleaning station 28 with cleaning brush. In the throttling operation, the throttle flap 29 is located in the 45° position shown, that is to say the applied vacuum is reduced by means of partial closure of the suction duct 27. In the cleaning operation, it is pivoted into a 90° position and thus opens the suction duct 27. The vacuum is now fully applied to the cleaning station.

On the output side, the cyclone filter 24 is connected, via a further suction duct 30, to a vacuum-producing device 31. The latter contains a fine particle filter 32 with associated vacuum sensor 33 for detecting the vacuum in the device 31 and a drive motor 35, which is coupled to a turbine 34, and an air distributor 36

A vacuum paper brake 37, which is arranged in the paper transport duct of the printing device, is coupled via a further suction duct 38 to the suction duct 30. The vacuum on the paper brake 37 is controlled via an electrically adjustable throttle flap 39 and a solenoid valve 40.

A suction duct 41, which connects the toner recycling device 25 to the toner transport duct 23, is used for supplying the toner which is regained via the toner recycling device 25 to the toner box 16 of the developer station. The toner transport duct 23 is in addition coupled via a suction duct 42 to a toner supply container 43 for fresh toner.

The toner supply container 43 contains a toner bottle 44, which is arranged so as to be exchangeable, and a suction pipe 45 which can be inserted into the toner bottle 44. In the case of applying vacuum to the suction duct 42, ambient air is sucked in via the suction pipe 45. The air catches the toner particles 13 in the toner bottle 44 and transports them via the suction duct 42 to the toner box 16. In order to be able to control the supply, either of the recycled toner from the toner recycling device 25 or of fresh toner 13 from the toner supply container 43, a toner supply valve 46 in the form of a two-way valve is arranged between the suction ducts 41 and 42, by means of which valve the suction ducts 41 and 42 can be alternately opened and closed. The construction of the toner supply valve 46 will be described in more detail later.

The toner transport in the toner transport system is controlled via a control arrangement 47, which can be a constituent of the machine control system of the controller of the machine. The controller can be a common microprocessor-controlled controller, which is connected via a bus line to an operating panel 48 of the machine. via the operating panel 48, and a menu control, the operating parameters of the machine, such as printing width, fixing temperature, printing operation, cleaning operation etc. can be entered or specified. Coupled to the controller or constituent of the machine control system is a measured value acquisition and drive arrangement 49, which is used to acquire and to convert the signals received from the various sensors of the toner transport device and to control the toner transport via the vacuum. The arrangement is constructed, in terms of hardware, as a common microprocessor-controlled arrangement.

The toner transport device is used for the transport of toner and particles in the printing machine. Inter alia, it enables fresh toner to be transported from the toner supply container 43 into the developer station 10, a mixture of toner and dirt particles to be sucked out of the developer station 10 and of the cleaning station 28, the mixture to be separated from the air stream using the cyclone filter 24, to be separated in the toner recycling device 25 into recyclable toner and into dirt particles, end the separated recyclable toner to be supplied anew to the developer station 10. Furthermore, it enables the separated dirt particles from the developer station 10 end cleaning station 28 and from the paper brake 37 to be collected in the fine filter 32 of the vacuum-producing device 31. For all these functions, controlled in accordance with the function, vacuum is applied to the various units such as supply container 43, developer station 10, cleaning station 28, paper brake 37 and toner recycling device 25.

The various functions of the toner transport device will now be described in more detail, with reference to the units participating in the functions:

Toner recycling

Figure 2:
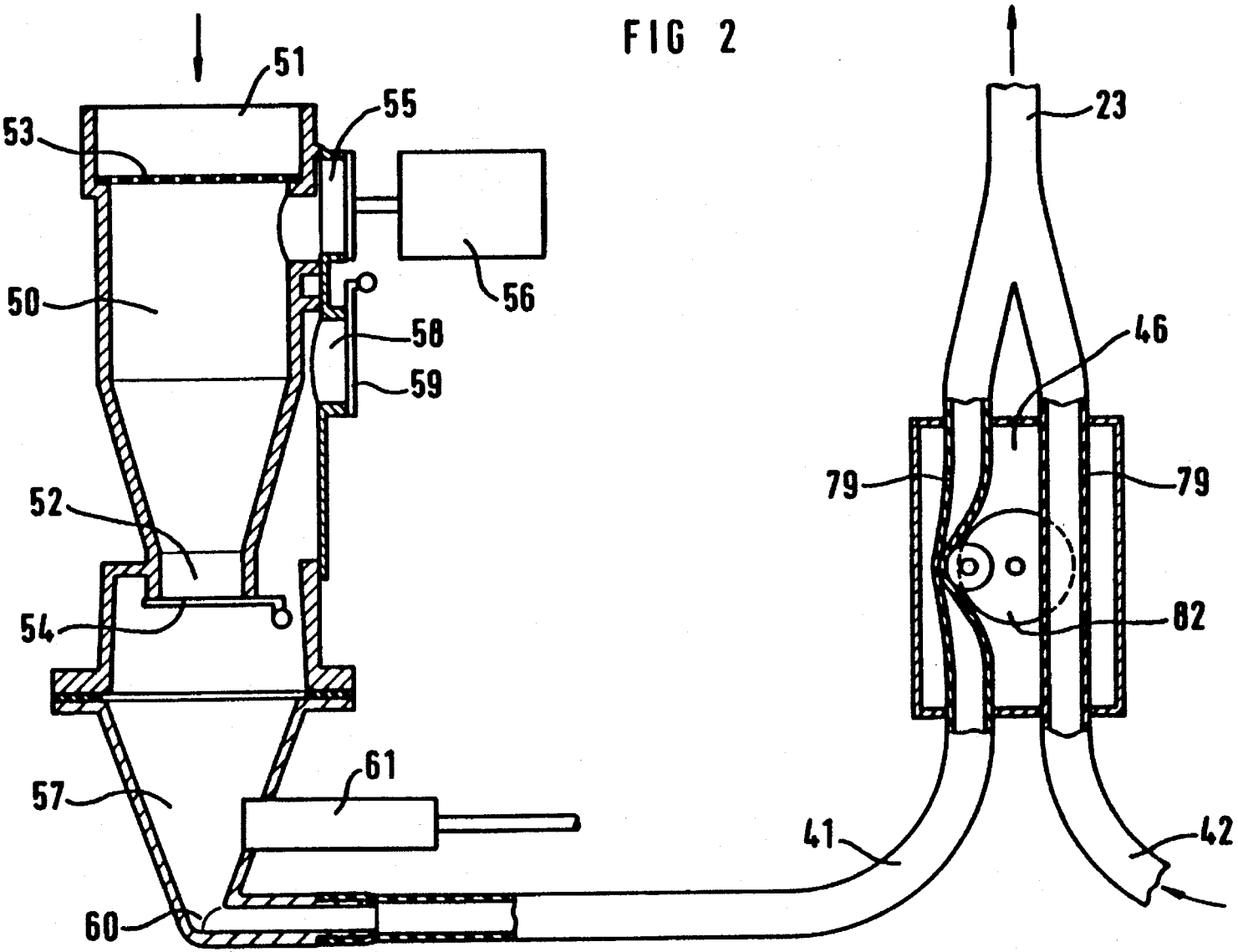
FIG. 2 shows a sectional representation of a toner recycling device, with associated toner path valve, arranged in the pneumatic transport device.

An essential functional element for the toner recycling is the toner recycling device 25, the principle of whose construction is represented in FIG. 2. In detail, the construction emerges from FIGS. 7 and 8. The toner recycling device contains a filter space 50 having an opening region 51 towards the cyclone filter 24 and an exit region 52. In the opening region 51, a particle sieve or particle filter 53 is arranged. A controllable closure flap 54 closes or opens the exit region 52. Furthermore, the filter space 50 has an air supply opening 55. The air supply opening 55 has assigned to it an electrically actuable solenoid valve 56, which opens or closes the air supply opening 55, as required, and thus connects the filter space 50 with the ambient air. Coupled to the filter space 50 via its exit region 52 is a toner settling space 57. It likewise has an air supply opening 58, which can be opened and closed with respect to the ambient air via a controllable closure flap 59. The toner settling space 57 is of funnel-shaped design and is coupled, via an opening region 60, to the suction duct 41 to the toner box 16. The toner settling space 57 contains, in addition, a toner sensor 61 for determining the toner filling level in the toner settling space 57 by means of capacitive measurement.

Figure 7:
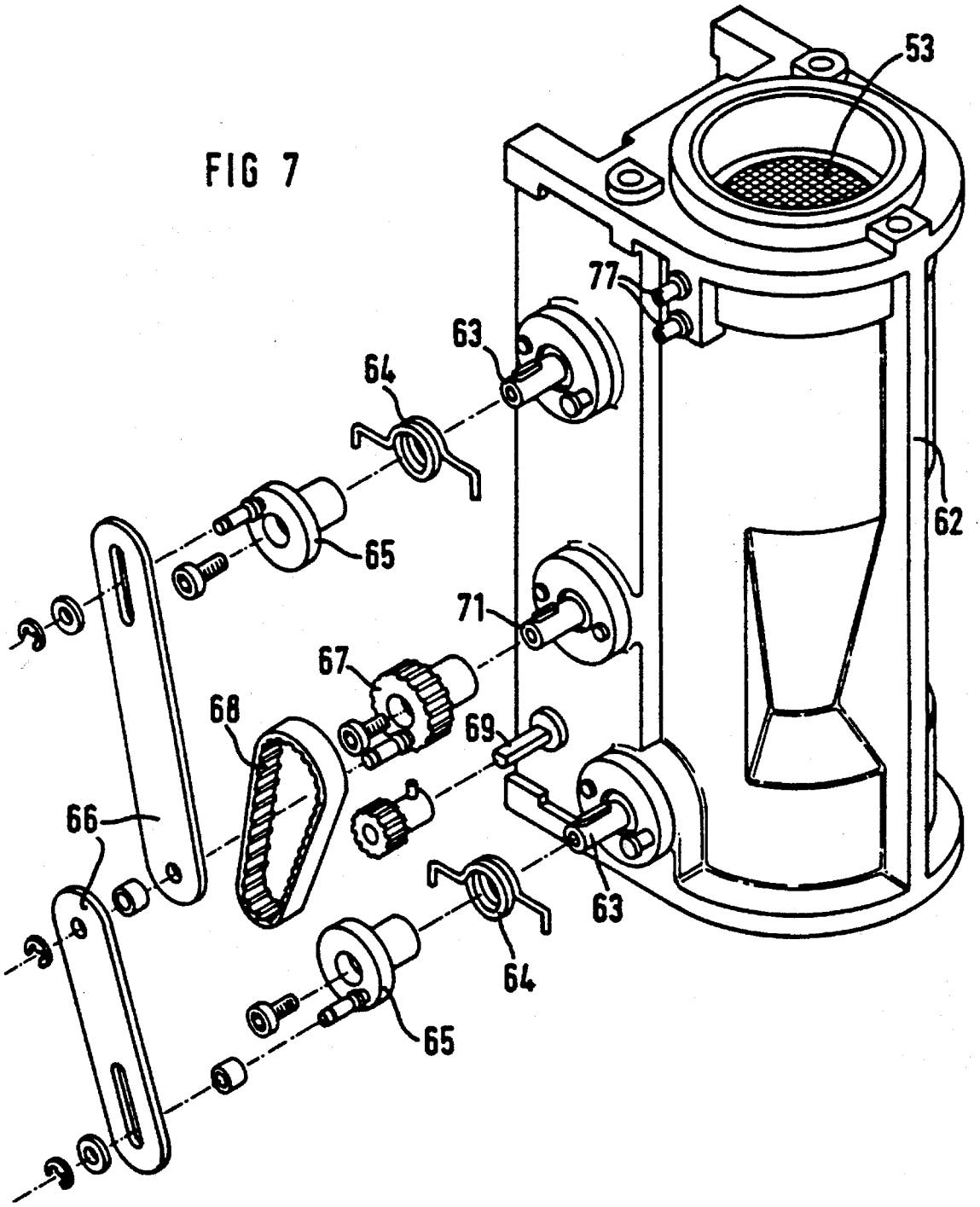
FIG. 7 and FIG. 8 show exploded representations of the toner recycling device and FIG. 9 shows an exploded representation of a toner control valve.
Figure 8:
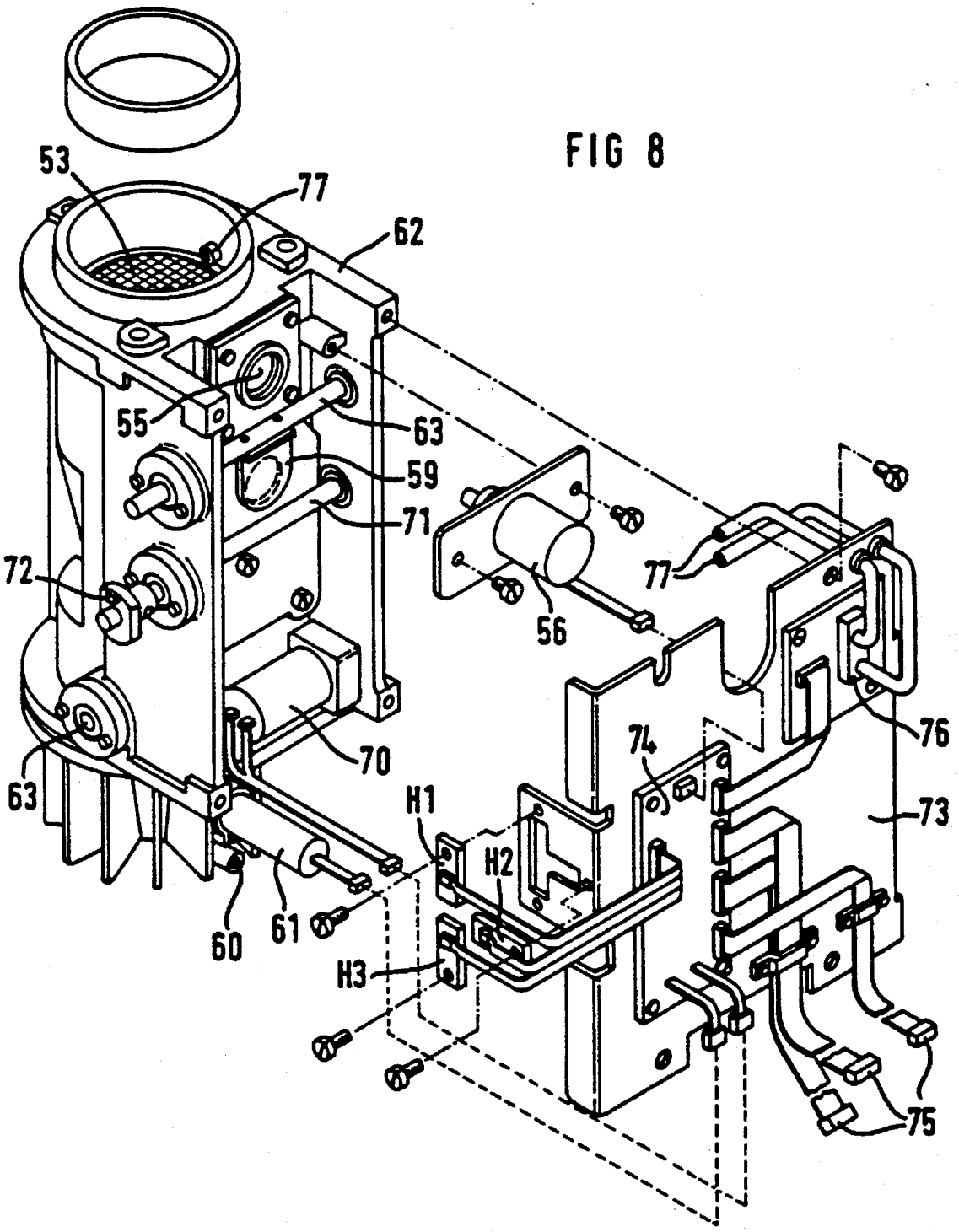

As can be seen from FIGS. 7 and 8, the filter space 50 and the toner settling space 57 are arranged in a housing 62, which accommodates the functional elements of the recycling device. These are: the particle sieve 53, for example made of a wire mesh, which is interchangeably arranged in the opening region 51 to the cyclone filter. The solenoid valve 56 for opening and closing the air supply opening 55. The controllable closure flaps 54 and 59 on the filter space 50 and on the toner settling space 57, and the associated drive elements for actuating the closure flaps 54 and 59.

The closure flaps 54, 59 are pivotably supported on axles 63, which project on one side out of the housing 62 (FIG. 7). Arranged on the outwardly projecting axles 63 are closing springs 64, which cooperate with actuating elements 65. The actuating elements 65 are, in turn, connected via push rods 66 to a drive element 67, which is coupled via a toothed belt 68 to a drive-shaft 69 of a geared motor 70.

An axle 71, which accommodates the drive element 67 for the push rods 66 projects with its opposite axle end out of the housing 62 (FIG. 8), on which a position transmitter 72 in the form of a magnet is arranged. The latter cooperates with three position sensors (Hall sensors) H1, H2 and H3 fastened on a supporting plate 73. They are used for scanning the position of the axle 71 and thus for scanning the position of the flaps 54 and 59. The supporting plate 73 also accommodates a control subassembly 74 in the form of a circuit, which can be connected via connections 75 to the drive arrangement 49. In addition, there is arranged on the supporting plate 73 a differential pressure sensor 76, which is electrically coupled to the control subassembly 74. Two pressure ducts 77 of the differential pressure sensor 76 open below and above the particle sieve 53 in the opening region 51 of the filter space 50. They acquire, via the differential pressure sensor 76, the differential pressure across the particle sieve 53 and thus the degree of soiling of the particle filter 53. If the differential pressure is high, the particle sieve 53 is soiled and thus non-porous. In the case of an unsoiled particle sieve, the particle sieve is porous.

If the axle 71 is rotated via the geared motor 70 and the push rods 66 are thereby actuated, the flaps 59 and 54 are closed as a function of the rotational position, the closure being carried out against the spring force of the closing springs 64. During a corresponding further rotation of the axle 71, the flaps 54 and 59 are opened again automatically, under the action of the closing springs 64.

Figure 9:
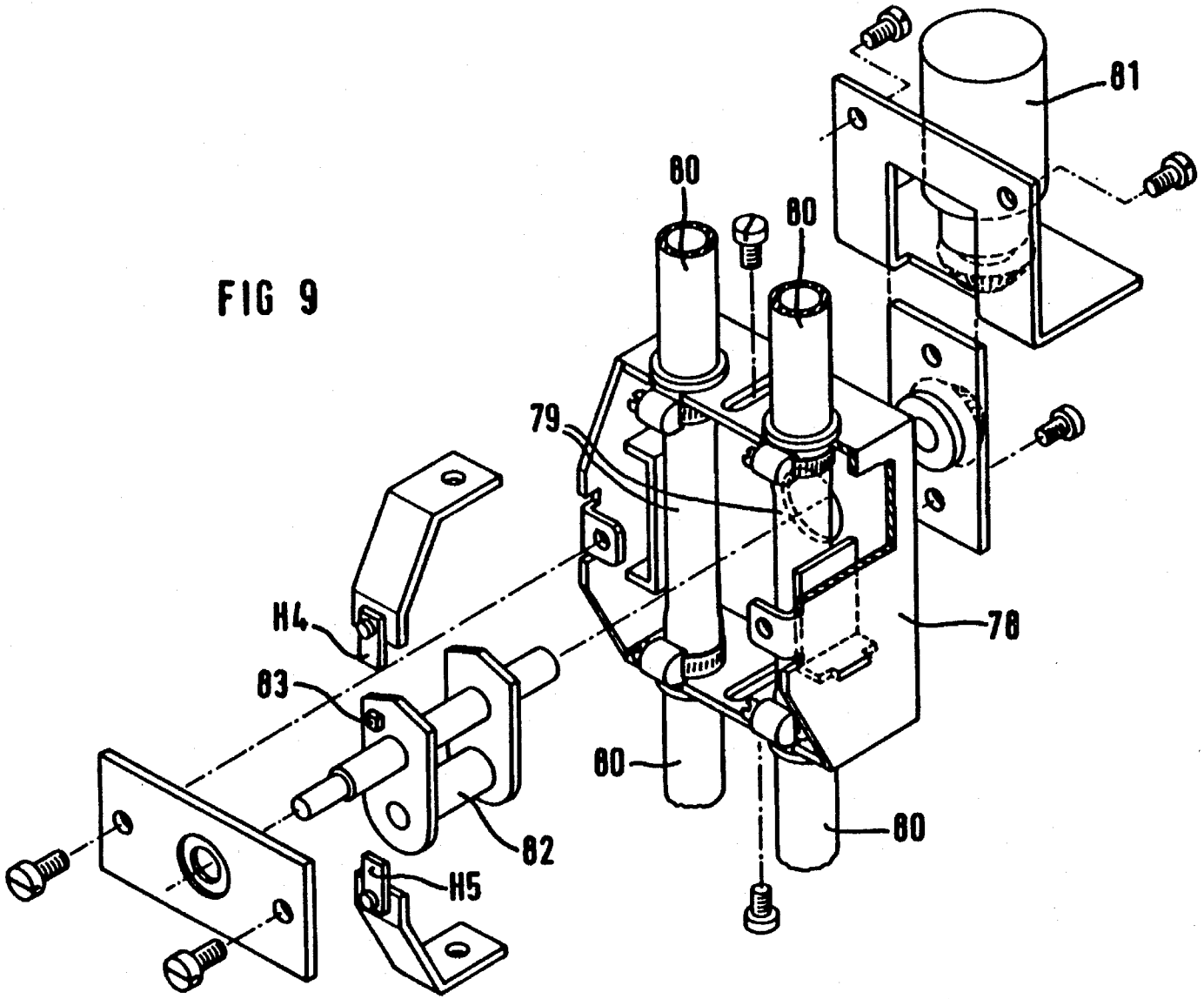

A further significant functional element for the toner recycling and the fresh toner supply to the developer station is the toner supply valve 46 for opening and closing the suction ducts 41 and 42 (FIG. 1). As shown in FIG. 9 in conjunction with FIG. 1, the toner supply valve 46 consists of two silicone hoses 79 arranged in a carrier 78 and having connecting stubs 80 for the suction ducts 41 and 42. Between the silicone hoses 79 there is located an eccentric roller 82, which can be rotated via a drive motor 81, which squeezes the silicone hoses 79 as a function of its rotational position and thus closes or opens them. Arranged on the eccentric roller 82 is a magnet 83 as position transmitter, which cooperates with position sensors (Hall sensors) H4 and H5. These are assigned in fixed positions to the carrier 78. As a function of the rotational position of the eccentric roller 82 and thus of the closing condition of the silicone hoses 79, the position sensors H4 and H5 deliver a scanning signal to the drive arrangement 49 of the controller 47.

Functional description of the toner recycling device

Figure 3:
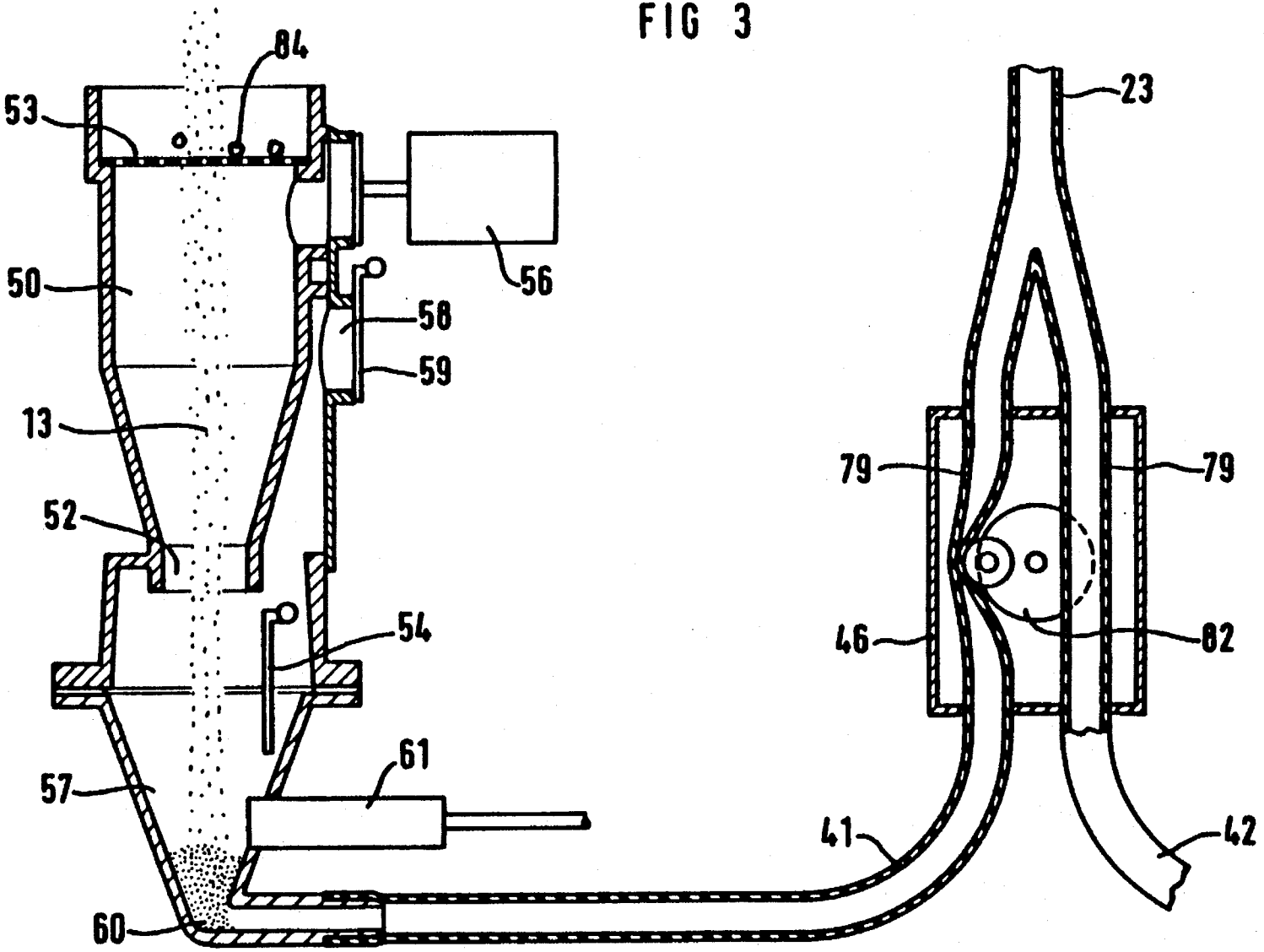
FIG. 3 shows a sectional representation of the toner recycling device in the normal condition during the printing operation.
Figure 4:
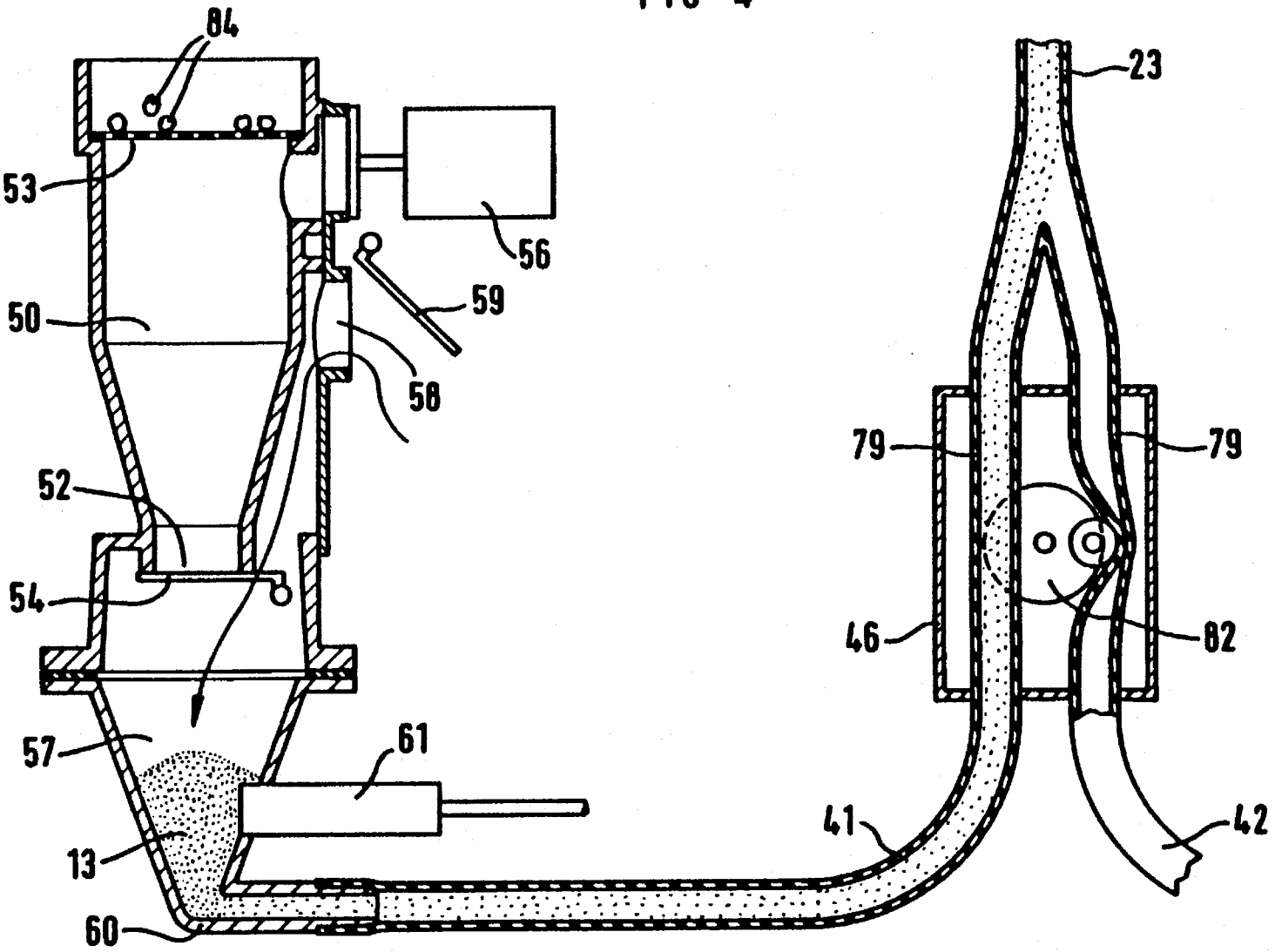
FIG. 4 shows a sectional representation of the toner recycling device in the event of feeding back toner during the printing operation.
Figure 5:
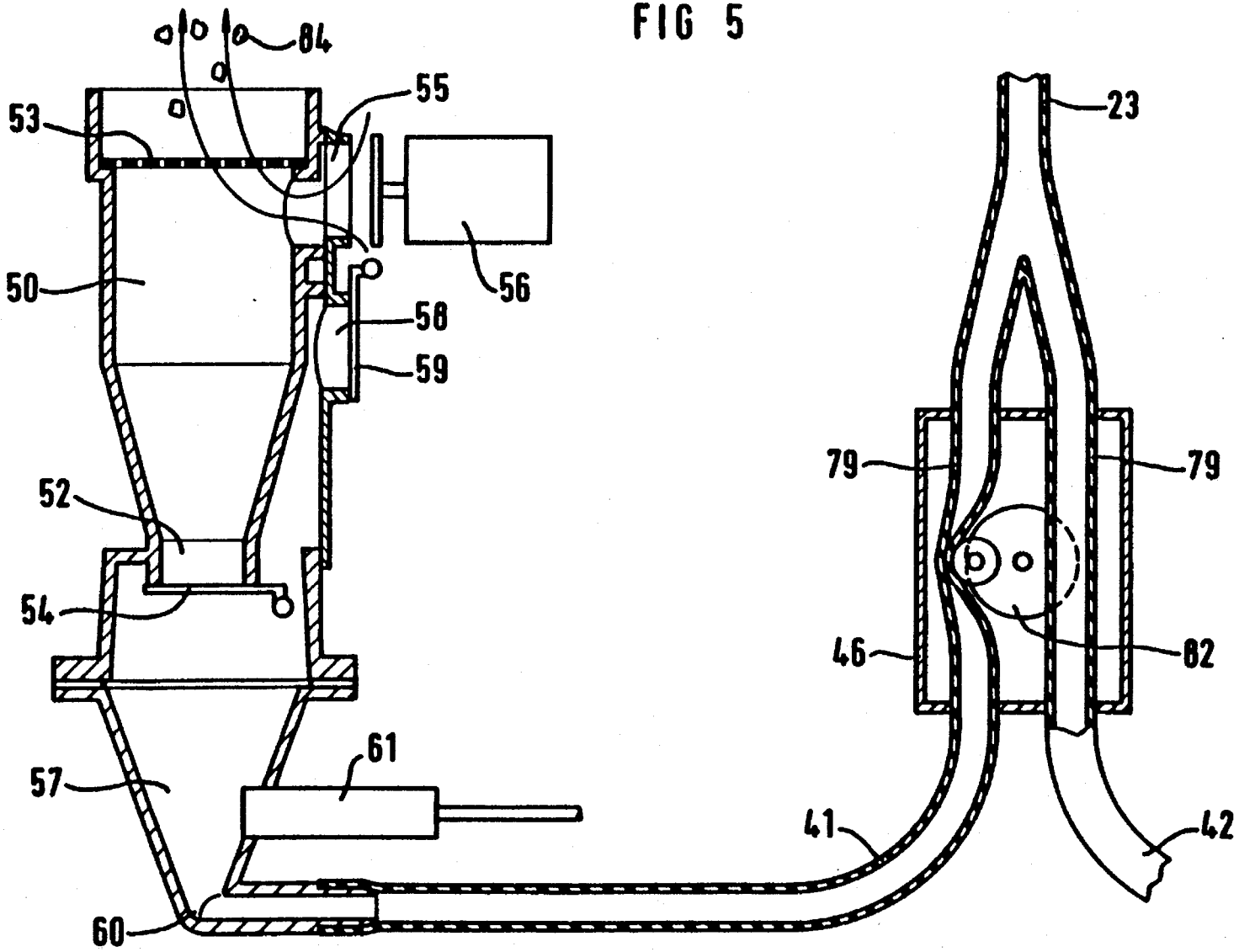
FIG. 5 shows a sectional representation of the toner recycling device in the cleaning operation.

As a function of the drive signals of the drive arrangement 47, the toner recycling device 25 can be set into three operational conditions, which are distinguished from each other essentially by the various flap positions of the flaps 59 and 54 and the setting condition of the toner valve 46. These are:

FIG. 3, normal condition during the printing operation;

FIG. 4, recycle condition for feeding back toner during the printing operation;

FIG. 5, cleaning condition for cleaning the particle sieve 53 and for feeding back the dirt particles into the fine filter 32 of the vacuum-producing device 31 as required, for example during a printing pause.

In the normal condition (FIG. 3), the air valve 56 of the filter space 50 is closed, as is the air supply opening 58 of the toner settling space 57, via the flap 59. The flap 54, assigned to the exit region 52 of the filter space 50, is opened. The suction duct 41 is closed in an airtight manner via the toner supply valve 46. Hence, the same pressure ratios prevail in the cyclone filter 54, in the filter space 50 and in the toner settling space 57, and the recyclable toner particles from the cyclone filter 24 fall through the particle sieve 53 into the toner settling space 57 and are collected there. Non-recyclable, overlarge lumps of toner which has gone lumpy or dirt particles 84 remain in the cyclone filter 24, held back by the particle sieve 53.

In order to be able to supply fresh toner as necessary from the toner supply container 43, the suction duct 42 is opened. If, as a function of the output signal of the toner filling level sensor 22 of the toner box 16, fresh toner is required, the suction-cycle valve 19 is opened under control of the drive arrangement 49 and vacuum is thus applied to the toner transport duct 23. The airstream thus generated in the suction pipe 45 of the toner supply container 43 transports fresh toner out of the toner bottle 44 into the toner box 16.

If sufficient recyclable toner has been collected in the toner settling space 57, the filling state being scanned via the toner sensor 61, the recyclable toner is fed back during the printing operation into the toner box 16 of the developer station (FIG. 4). For this purpose, driven via the drive arrangement 49, the flap 54 of the filter space 50 is closed and the flap 59 of the air supply opening 58 of the toner settling space 57 is opened. The toner supply valve 46 opens the suction duct 41 and closes the suction duct 42 to the toner supply container 43. Driven vim the drive arrangement 49, the suction-cycle valve 19 is opened, by which means vacuum is applied to the toner transport duct 23 and thus to the suction duct 41. Via the opened air supply openings 58, ambient air is sucked in, flows through the toner settling space 57 and thus transports the recyclable toner which has been collected in the toner settling space 57, via the suction duct 41 and the toner transport duct 23, to the toner box 16.

If, in the cyclone filter 24, a sufficient of dirt particles 84 have been collected to stop the particle sieve 53, the differential pressure sensor 76 reports a corresponding differential pressure across the particle sieve 53 and, as required, for example during a printing pause, the toner recycling device 25 is put into the cleaning condition (FIG. 5). In this case, driven by the drive arrangement 49 via the toner supply valve 46, the suction duct 41 is closed. Also closed are the flap 59 of the air supply opening 58 of the toner settling space 57 and the flap 54 of the filter space 50. The solenoid valve 56 opens the air supply opening 55 of the filter space 50, as a result of which air flows through the air supply opening 55, via the particle filter 53, into the cyclone filter 24. The suction-cycle valve 19 of the toner box 16 is closed. The airstream thus generated transports the dirt particles 84 into the fine filter 32 of the vacuum-producing device 31, where they are collected.

Description of a recycling sequence in detail:

In the printing operation, the recycling device 25 is in the normal condition represented in FIG. 3. In this arrangement, recyclable toner is collected in the toner settling space 57. After reaching a toner filling level which can be predetermined by means of the position and the response threshold letting of the toner sensor 61, the toner sensor 61 responds and reports a corresponding filling level signal to the drive arrangement 49. As a function of the filling level signal, the drive arrangement 49 starts the geared motor 70 for flap actuation. The geared motor 70 now runs until the magnet 72 of the position transmitter reaches the region of the Hall sensor H2. In so doing, the flap 54 of the filter space 50 is closed. After reaching the Hall transmitter H2, the geared motor 70 stops. The Hall transmitter H2 simultaneously starts the drive motor 81 of the toner supply valve 46. As a result, the eccentric roller 82 is pivoted into the position represented in FIG. 4, in which it clamps off the suction duct 42 and opens the suction duct 41. The Hall sensor H5 stops the eccentric roller 82 in this position. Under control of the output signal of the Hall sensor H5, the geared motor 70 starts up once again and opens the flap 59 of the air supply opening 58 of the toner settling space 57. After reaching the position of the Hall sensor H3, the geared motor 70 is stopped again. The Hall sensor H3 simultaneously triggers the suction process, in that the suction-cycle valve 19 is opened, driven via the drive arrangement 49, and a timing stage assigned to the drive arrangement 49 is switched on. During the suction process, the output signal of the toner sensor 61 falls again. The timing stage switches on the drive motor 81 of the toner supply valve 46 once again after a presettable time of, for example, 2 seconds, as a result of which the eccentric roller 82 rotates once more, opens the suction duct 42 and clamps off the suction duct 41. The output signal of the Hall sensor H4 terminates the switchover and thus the suction process. At the same time, via the output signal of the Hall sensor H4, the suction-cycle valve 19 is closed and the geared motor 70 is started once more anew. On reaching the Hall sensor H1, the geared motor 70 stops once again. The end of the recycling process is thus achieved. During the rotation in the region of the Hall sensor H1, the flap 59 of the air supply opening 58 was closed again by means of the closing spring 64 and the flap 54 of the filter space 50 opened once more via the push rods 66. Hence, the output position assigned to the normal condition during the printing operation is reached once more. Recyclable toner can be collected anew in the toner settling space 57.

By means of the automatic sequence of the toner recycling process, a constant mixing ratio of regained toner and fresh toner is maintained in the toner box 16. If, for example, a great deal of toner is used, because for example, large areas are inked in in the printing operation, the filling level sensor 22 reports a corresponding use to the drive arrangement 49. There then follows an increased supply of fresh toner from the supply container 43. In turn, because of the increased use of toner, a great deal of residual toner occurs at the cleaning station, from which recyclable toner is obtained in the recycling device 25 and supplied to the toner box 16. Since the supply is carried out as a function of the filling level in the toner settling space 57, the supply cycle is increased. The original mixing ratio is thus set once more. In the steady state, this amounts to approximately 30% regained toner sad 70% fresh toner. Irrespective of the use of toner, a constant printing quality is thus guaranteed.

In the described exemplary embodiment, the toner recycling process in the printing operation runs automatically as a function of the toner filling level in the toner settling space 57. However, it is also possible to start the toner recycling process deliberately by calling it up via the operating panel 48.

Figure 6:
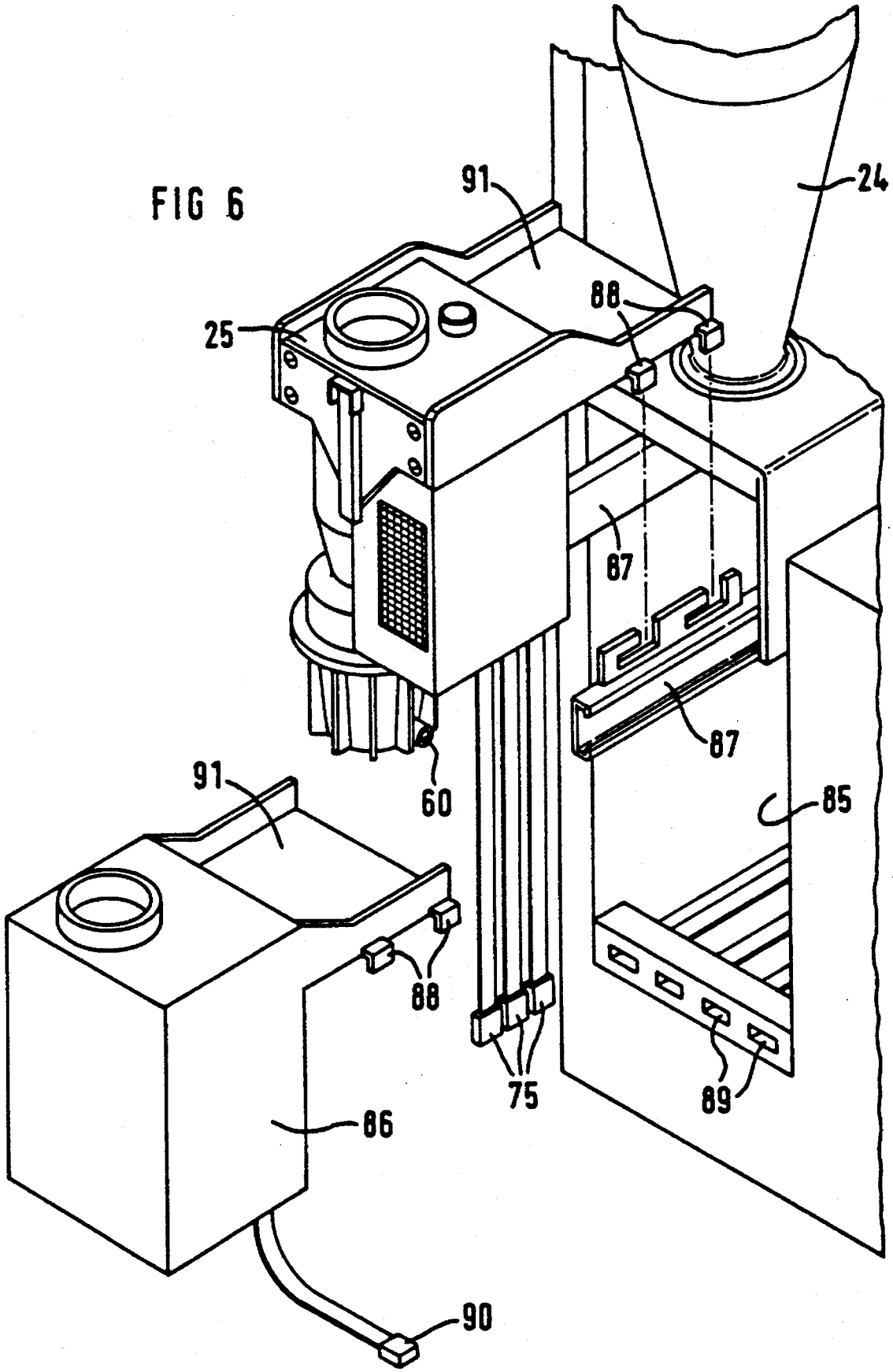
FIG. 6 shows a schematic perspective representation of an alternative arrangement of a toner recycling device or of a toner catchbox in the machine.

In the case of very high requirements on the printing quality, it can be favorable to refrain from toner recycling. For this purpose, and to facilitate any maintenance operations on the machine, the toner recycling device 25 is designed, corresponding to the representation of FIG. 6, as an exchangeable constructional unit in the form of a recycling insert.

In the printing machine, underneath the cyclone filter 24, there is arranged a drawer opening 85, which is used for the exchangeable accommodation both of the recycling insert (recycling device 25) and of a catchbox 86. The catchbox 86 is a catchbox for catching particles separated by means of the cyclone filter 24. If a specific filling level is reached in the catchbox 86, this is removed and the particles of toner particles and dirt particles collected therein are thrown away.

In order to enable this exchange between a catchbox 86 and the recycling insert 25 in a simple manner, the drawer opening 85 contains guide rails 87, which cooperate with corresponding guide elements 88, for example in the form of hooks, on the catchbox 86 and the recycling insert 25. On the bottom of the drawer opening 85 there are electrical connecting sockets 89 for accommodating the connecting plugs 75 of the recycling insert 25 or a connecting plug 90 of the catchbox 86. The drive arrangement 49 recognizes, via the previously mentioned connections, whether the collecting container pushed in is the catchbox 86 or a recycling insert 25. The corresponding functions are connected as a function thereof.

The connections for the opening region 60 and the electrical connections for the drive motor 70 of the recycling insert or the electrical connections 90 of the catchbox 86 can be designed such that, by means of the drawer in the drawer opening 85, an automatic contact can be given or an automatic connection can be made between opening region 60 and suction duct 41. In addition, locking devices can be provided, which allow an exchange only as a function of the operating condition of the machine and which, for example, ensure that the suction duct 41 is closed during exchange.

Since, during exchange of the inserts, the exit region of the cyclone filter 24 is free, toner particles contained therein can fall into the drawer opening 85 end soil this. In order to prevent this, the inserts (catch-box 86 or recycling insert 25) have a catching trough 91, which catches the residual particles contained in the cyclone filter 24 during the exchange. It is also possible to arrange, in the region of the exit opening of the cyclone filter 24, a closure, for example in the form of a slide, which closes the cyclone filter 24 as required during the exchange. In addition, it is possible to arrange this slide in a displaceable manner in the drawer opening 85 via guide rails and to provide it with fastening means for the exchangeable fastening of the inserts, whether it be the catchbox 86 or the recycling insert 25.

As already described at the beginning, the toner particles are charged up triboelectrically in the developer station for inking in the latent toner image on the photoconductor. So that this triboelectric charging up or other such charges do not disturb the toner transport in the toner transport device, the duct system accommodating the toner consists of electrically conductive material, for example of metal or of conductive plastic. To dissipate any charges, the duct system is grounded. In order to make this dissipation possible, the inner surfaces of the duct system, coming into contact with the toner, can be coated with a conductive layer or corresponding grounding conductive tracks are located on the inner surface of the duct system.

In the exemplary embodiment of the toner transport device represented in FIG. 1, a cyclone filter is arranged as particle separator 24. Instead of the cyclone filter, it is also possible to arrange other particle separators, for example sieves or the like. For this purpose, it is possible to replace the flaps in the toner recycling device 25 by corresponding other closures such as sliding elements or closure valves. As far as the design of the toner supply valve 46 is concerned, this can be replaced by corresponding functionally similar valves, which operate with slides or other mechanical closure devices.

It should be understood that various changes and modifications to the presently preferred embodiments will be apparent to those skilled in the art. Such changes and modifications may be made without changing the spirit and scope of the present invention and without diminishing its attendant advantages. Therefore, such changes and modifications are intended to be covered by the appended claims.

| List of reference symbols | |
|---|---|
| 10 | Developer station |
| 11 | Developer station housing |
| 12 | Metering device |
| 13 | Toner |
| 14 | ltmptying opening |
| 15 | Suction duct |
| 16 | Toner box |
| 17 | Toner filter |
| 18 | Air transport channel |
| 19 | Suction-cycle valve, solenoid valve |
| 20 | Motor |
| 21 | Stirring blade, mixing device |
| 22 | Toner filling level sensor |
| 23 | Toner transport duct |
| 24 | Particle separator, cyclone filter |
| 25 | Toner recycling device, recycling insert |
| 26, 27 | Suction duct |
| 28 | Cleaning station |
| 29 | Throttle flaps |
| 30 | Suction duct |
| 31 | Vacuum-producing device |
| 32 | Fine particle filter |
| 33 | Vacuum sensor |
| 34 | Turbine, blower |
| 35 | Drive motor |
| 36 | Air distributor, fumes |
| 37 | Paper brake |
| 38 | Suction duct |
| 39 | Throttle flap |
| 40 | Solenoid valve |
| 41, 42 | Suction duct |
| 43 | Toner supply container for fresh toner |
| 44 | Toner bottle |
| 45 | Suction pipe |
| 46 | Toner supply valve |
| 47 | Controller, control arrangement |
| 48 | Operating panel |

-continued

| List of reference symbols | |
|---|---|
| 49 | Measured value, acquisition and drive arrangement, control arrangement |
| 50 | Filter space |
| 51 | Opening region |
| 52 | Exit region |
| 53 | Particle sieve, particle filter |
| 54 | Controllable closure flap |
| 55 | Air supply opening |
| 56 | Solenoid valve, air valve |
| 57 | Toner settling space |
| 58 | Air supply opening |
| 59 | Controllable closure flap |
| 60 | Opening region |
| 61 | Toner sensor |
| 62 | Housing |
| 63 | Axles |
| 64 | Closing spring |
| 65 | Actuating elements, control elements |
| 66 | Push rods |
| 67 | Drive element |
| 68 | Toothed belt |
| 69 | Driveshaft |
| 70 | Geared motor |
| 71 | Axle |
| 72 | Position transmitter |
| H1, H2, H3 | Hall sensors, position sensors |
| 73 | Supporting plate |
| 74 | Control subassembly |
| 75 | Connectors, plugs |
| 76 | Differential pressure sensor |
| 77 | Pressure duct |
| 78 | Carrier |
| 79 | Silicone hoses |
| 80 | Connecting stubs |
| 81 | Drive motor |
| 82 | Eccentric roller |
| 83 | Magnet, position transmitter |
| H4, H5 | Position sensors, Hall sensors |
| 84 | Dirt particles |
| 85 | Drawer opening |
| 86 | Catchbox |
| 87 | Guide rails |
| 88 | Guide element, hook |
| 89 | Connecting socket |
| 90 | Connecting plug |
| 91 | Catching trough |

What is claimed is:

1. A pneumatic transport device for transporting toner to an electrographic imaging machine and for removing toner and dirt particles from the machine, the transport device comprising:

a vacuum-producing device in communication with at least one selected location of the machine via a duct system to remove a flow of air and excess toner particles;

a particle separator through which the duct system provides the flow, the separator having means for separating the toner and dirt particles from the air flowing through the particle separator;

a toner recycling device arranged to collect a toner particle mixture from the particle the toner recycling device separating recyclable toner from the particle mixture collected from the particle separator and supplying the recyclable toner, via a recycled toner transport duct to a developer station of the machine;

a toner metering device providing toner to the developer station, the metering device receiving a supply of toner from the toner recycling device and a fresh toner container; and means for controlling the supply of recyclable toner and fresh toner to the toner metering device.

2. The pneumatic transport device as claimed in claim 1, wherein the toner recycling device is an independent, exchangeable module.

3. The pneumatic transport device as claimed in claim 2, further comprising:

coupling means for interchangeably connecting either a particle mixture accommodation container or the toner recycling device operably with the particle separator.

4. The pneumatic transport device as claimed in claim 1, wherein the toner recycling device comprises:

a filter space having:

an opening in communication with the particle separator;

a particle filter being disposed in the opening;

an exit region closeable by a controllable closure element; and an air supply opening into the filter space with an associated controllable closure element;

a toner settling space disposed under the exit region to receive collected toner particles therefrom, the toner settling space having a closeable air supply opening with an associated controllable closure element and an opening region through which toner particles flow to the transport duct.

5. The pneumatic transport device as claimed in claim 4, further comprising:

a control device to actuate the closure elements; of the toner recycling device wherein, for cleaning the particle filter and for transporting away the dirt particles, the exit region of the filter space is closed and the air supply opening of the filter space is opened;

wherein, for supplying the recyclable toner to the toner settling space when vacuum supplied to the transport duct is interrupted, the exit region of the filter space is opened and the air supply opening of the filter space is closed; and wherein, for supplying the recyclable toner to the developer station when vacuum is applied to the transport duct, the exit region of the filter space is closed and the air supply opening of the toner settling space is opened.

6. The pneumatic transport device as claimed in claim 4, further comprising:

a sensor device disposed in the toner settling space, the sensor device detecting a toner filling level in the toner settling space.

7. The pneumatic transport device as claimed in claim 1, further comprising:

a fresh toner transport duct which delivers toner to the developer station from a fresh toner supply container; and a controllable closure device operably to alternatingly close the recycled toner transport duct and the fresh toner transport duct.

8. The pneumatic transport device as claimed in claim 7, wherein the controllable closure device is a two-way valve having transport ducts arranged on opposite sides of a rotatable eccentric roller, the eccentric roller alternatingly squeezing the transport ducts as the eccentric roller rotates.

9. The pneumatic transport device as claimed in claim 1, wherein the toner metering device includes a buffer container which can receive toner from the toner recycling device and from the fresh toner container, the buffer container further including a selectively closable closure device to a duct in communication with the vacuum-producing device.

10. The pneumatic transport device as claimed in claim 1, wherein the vacuum-producing device comprises:

a fine particle filter for picking up the dirt particles from the airflow through the vacuum-producing device.

11. The pneumatic transport device as claimed in claim 1, wherein the particle separator comprises a cyclone filter.

12. The pneumatic transport device as claimed in claim 4, further comprising:

a sensor detecting a pressure difference upstream and downstream of the particle filter to determine whether the filter is soiled.

13. The pneumatic transport device as claimed in claim 1, wherein the duct system has wall regions which contact the toner, dissipate charges and are made of electrically conductive material.

14. A process for the pneumatic transport of toner and for the removal of toner and dirt particles from a developer station and cleaning station of an electrographic imaging machine, having the method comprising the following steps:

suctioning a mixture of excess toner and dirt particles the developer station and cleaning station machine by applying a vacuum to the units via a duct system;

separating the suctioned particle mixture into non-reusable dirt particles and reusable toner;

mixing the reusable toner with fresh toner at a rate proportional to accumulation of reusable toner such that a constant mixing ratio is obtained;

supplying the mixed toner to the developer station; and collecting the dirt particles (84) in a catching device.

* * * * *